US010506825B2

(12) United States Patent
Besso et al.

(10) Patent No.: US 10,506,825 B2
(45) Date of Patent: Dec. 17, 2019

(54) SMOKING ARTICLE WITH TACTILE LIQUID RELEASE COMPONENT

(71) Applicant: PHILIP MORRIS PRODUCTS S.A., Neuchatel (CH)

(72) Inventors: Clement Besso, Neuchatel (CH); Laurent Lavanant, Evian-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 91 days.

(21) Appl. No.: 15/113,537

(22) PCT Filed: Dec. 18, 2014

(86) PCT No.: PCT/EP2014/078578
§ 371 (c)(1),
(2) Date: Jul. 22, 2016

(87) PCT Pub. No.: WO2015/128027
PCT Pub. Date: Sep. 3, 2015

(65) Prior Publication Data

US 2017/0035102 A1 Feb. 9, 2017

(30) Foreign Application Priority Data

Feb. 26, 2014 (EP) ..... 14156849

(51) Int. Cl.
*A24D 3/06* (2006.01)
*A24B 15/28* (2006.01)

(52) U.S. Cl.
CPC ..... *A24D 3/061* (2013.01); *A24B 15/283* (2013.01); *A24B 15/282* (2013.01)

(58) Field of Classification Search
CPC ..... A24D 3/061
See application file for complete search history.

(56) References Cited

U.S. PATENT DOCUMENTS 6,274,162 B1 8/2001 Steffenino
7,578,298 B2 8/2009 Karles
(Continued)

FOREIGN PATENT DOCUMENTS

CN 101115408 A 1/2008
CN 101203148 A 6/2008
(Continued)

OTHER PUBLICATIONS

PCT Search Report and Written Opinion for PCT/EP2014/078578 dated Mar. 5, 2015 (11 pages).
(Continued)

*Primary Examiner* — Eric Yaary
(74) *Attorney, Agent, or Firm* — Mueting, Raasch & Gebhardt, P.A.

(57) ABSTRACT

A smoking article (10) incorporates a liquid release component (20), the liquid release component comprising a sustained release liquid delivery material comprising: a closed matrix structure comprising a cross-linked polymer matrix defining a plurality of domains; and a liquid composition that is trapped within the domains and is releasable from the closed matrix structure upon compression of the material. The force/displacement curve (30) obtained upon compression of the smoking article (10) at the location of the liquid release component (20) in a force/displacement test comprises a plurality of local minima (32) in the force level over a range of compression of at least 1 mm, wherein each of the local minima (32) corresponds to a reduction in the force level of at least 1 Newton.

28 Claims, 2 Drawing Sheets

(56) References Cited

U.S. PATENT DOCUMENTS

Figure 1:
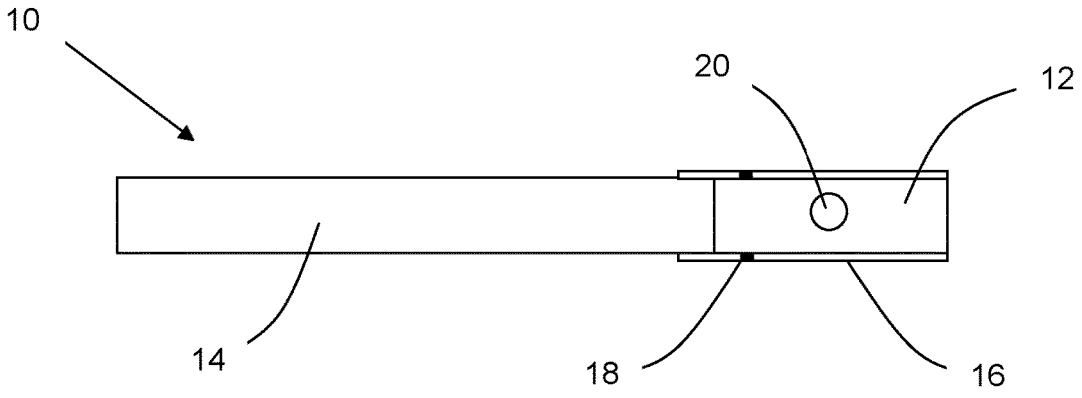

| | | | | |
|---|---|---|---|---|
| 7,878,962 | B2 | 2/2011 | Karles | |
| 8,820,331 | B2 | 9/2014 | Hartmann | |
| 9,339,060 | B2 | 5/2016 | Hartmann | |
| 9,986,759 | B2 | 6/2018 | Besso | |
| 2006/0144412 | A1 | 7/2006 | Mishra | |
| 2008/0302376 | A1 | 12/2008 | Karles | |
| 2011/0083676 | A1 | 4/2011 | Karles | |
| 2011/0083680 | A1* | 4/2011 | Mishra | A24B 15/283 131/275 |
| 2014/0026908 | A1* | 1/2014 | Motodamari | A24D 3/061 131/331 |

FOREIGN PATENT DOCUMENTS

| | | |
|---|---|---|
| JP | 2010-528650 | 8/2010 |
| TW | 201325477 | 7/2013 |
| UA | 90140 C2 | 4/2010 |
| WO | WO 2008/121610 | 10/2008 |
| WO | WO 2009/022232 | 2/2009 |
| WO | WO 2010/107613 | 9/2010 |
| WO | WO 2012/156699 | 11/2012 |
| WO | WO 2013/068304 | 5/2013 |

OTHER PUBLICATIONS

European Extended Search Report for Application No. 14156849.3 dated Aug. 11, 2014 (9 pages).

Office Action issued in China for Application No. 201480074853.8 dated Sep. 4, 2017 (17 pages). English translation included.

Office Action issued in Taiwan for Application No. 104100349 dated Jul. 27, 2018 (14 pages). English translation included.

Office Action issued in Ukraine for Application No. A201608776 dated Aug. 19, 2019 (12 pages). English translation included.

Office Action issued in Japan for Application No. 2016-552270 dated Aug. 1, 2019 (7 pages). English translation included.

* cited by examiner

SMOKING ARTICLE WITH TACTILE LIQUID RELEASE COMPONENT

This application is a U.S. National Stage Application of International Application No. PCT/EP2014/078578, filed Dec. 18, 2014, which was published in English on Sep. 3, 2015, as International Patent Publication WO 2015/128027 A1. International Application No. PCT/EP2014/078578claims priority to European Application No. 14156849.3 filed Feb. 26, 2014.

The present invention relates to a smoking article incorporating a sustained release liquid release component that provides a novel tactile sensation upon compression.

It is well known to incorporate flavourant additives into smoking articles in order to provide additional flavours to the consumer during smoking. Flavourants may be used to enhance the tobacco flavours produced upon heating or combusting the tobacco material within the smoking article, or to provide additional non-tobacco flavours such as mint or menthol.

The flavourant additives used in smoking articles, such as menthol, are commonly in the form of a liquid flavourant which is incorporated into the filter or the tobacco rod of the smoking article using a suitable liquid carrier. Liquid flavourants are often volatile and will therefore tend to migrate or evaporate from the smoking article during storage. The amount of flavourant available to flavour the mainstream smoke during smoking is therefore reduced.

It has previously been proposed to reduce the loss of volatile flavourants from smoking articles during storage through the encapsulation of the flavourant, for example, in the form of a capsule or microcapsule. The encapsulated flavourant can be released prior to or during smoking of the smoking article by breaking open the encapsulating structure, for example by crushing or melting the structure. Where such capsules are crushed to release the flavourant, the capsules break open at a particular force and release all of the flavourant at that force. The consumer will typically feel the breaking of the capsule and in some cases an audible sound may be produced as the capsule breaks open. The consumer therefore receives a sensory indication that the flavourant has been released.

It has also been previously proposed to provide a flavourant within a matrix material, wherein compression is applied to the matrix material in order to release the flavourant. The flavourant may be released more gradually than with a capsule. Unlike with the encapsulating structure of a capsule, the matrix structure does not break open to release all of the flavourant at a particular force but is gradually broken down as the force is sustained. In some cases, this type of release provides little or no indication to the consumer that the flavourant has been released from the matrix material.

It is also known to incorporate other types of non-flavourant liquid additives into smoking articles in order to adapt the smoke in some way during smoking. For example, certain liquid additives may be provided within a smoking article filter to alter the filtration properties of the filter during smoking.

It would be desirable to provide an improved liquid delivery material for a smoking article that provides an indication to the consumer that the liquid has been released from the material. It would be particularly desirable to provide such a material that provides a novel sensation when compressed by the consumer. It would further be desirable to provide such a material that shows improved retention of volatile liquid additives during storage and improved resistance to moisture and humidity.

According to the invention there is provided a smoking article incorporating a liquid release component, the liquid release component comprising a sustained release liquid delivery material. The liquid delivery material comprises a closed matrix structure comprising a cross-linked polymer matrix defining a plurality of domains. A liquid composition is trapped within the domains of the polymer matrix and is releasable from the closed matrix structure upon compression of the material. The force/displacement curve obtained upon compression of the smoking article at the location of the liquid release component in a force/displacement test comprises a plurality of local minima in the force level over a range of compression of at least 1 mm, wherein each of the local minima corresponds to a reduction in the force level of at least 1 Newton.

Preferably, the liquid release component comprises an inner core of the sustained released liquid delivery material and a frangible outer shell encapsulating the inner core of liquid delivery material.

According to the invention there is further provided a filter incorporating a liquid release component as defined above.

According to the invention there is further provided a flavour release component for a smoking article, the flavour release component comprising an inner core of a sustained-released flavour delivery material and a frangible outer shell encapsulating the inner core of flavour delivery material. The flavour delivery material comprises a closed matrix structure having a polymer matrix defining a plurality of domains. The polymer matrix is formed of one or more polysaccharides cross-linked by multivalent cations. A flavour composition is trapped within the domains of the polymer matrix and is releasable from the closed matrix structure upon compression of the material. The force/displacement curve obtained upon compression of a smoking article including the flavour release component at the location of the flavour release component in a force/displacement test comprises a plurality of local minima in the force level over a range of compression of at least 1 mm, wherein each of the local minima corresponds to a reduction in the force level of at least 1 Newton.

In the following description, any references to the features or properties of the liquid release component, flavour release component, sustained-release liquid delivery material or flavour delivery material according to the invention also apply to the liquid release component, flavour release component, liquid delivery material or flavour delivery material of smoking articles and filters according to the invention, unless stated otherwise.

Smoking articles according to the present invention incorporating the liquid release component may be filter cigarettes or other smoking articles in which tobacco material or another combustible material is combusted to form smoke. Alternatively, smoking articles according to the present invention may be articles in which an aerosol forming substrate, such as tobacco, is heated to form an aerosol, rather than combusted. In one type of heated smoking article, tobacco material or another aerosol forming material is heated by one or more electrical heating elements to produce an aerosol. In another type of heated smoking article, an aerosol is produced by the transfer of heat from a combustible or heat source to an aerosol forming substrate. The present invention further encompasses smoking articles in which a nicotine-containing aerosol is generated from a tobacco material, tobacco extract or other nicotine source, without combustion, and in some cases without heating, for example through a chemical reaction.

Smoking articles according to the invention may be whole, assembled smoking devices or components of smoking devices that are combined with one or more other components in order to provide an assembled device for producing an aerosol, such as for example, the consumable part of a heated smoking device.

As used herein, the term "smoke" describes smoke produced by combustible smoking articles, such as filter cigarettes, and aerosols produced by non-combustible smoking articles, such as heated or non-heated smoking articles of the types described above.

The term "liquid release component" is used throughout the present specification to refer to a discrete piece or portion of a liquid delivery material which is in a form that is suitable to be incorporated into a smoking article. The liquid release component is preferably in the form of a bead, as described below, but alternative forms such as, for example, a thread or flake, may be suitable in certain embodiments. In preferred embodiments, the liquid release component is a flavour release component for providing flavour in a smoking article. The liquid release component may or may not incorporate an outer shell around the liquid delivery material.

As used herein, the term "liquid" refers to compositions that are in a liquid state at room temperature (22° C.).

The term "liquid composition" refers to any liquid agent that can be incorporated into a component of an aerosol generating device in order to provide an effect on the aerosol or smoke generated during smoking. The liquid composition may be, for example, a substance that is capable of reducing one or more constituents of the aerosol. Alternatively, the liquid composition may be a substance that is capable of reacting with one or more other substances in the aerosol generating device to produce an aerosol. In preferred embodiments of the invention, the liquid composition is a liquid flavour composition and the liquid delivery material is adapted for providing flavour in a smoking article or a portion of a smoking article.

In the present specification, the expression "starch or starch derivative chemically modified to be amphiphilic" is used to describe a starch or starch derivative which has been treated or reacted with a compound containing hydrophobic groups such as to impart to the starch or starch derivative an amphiphilic nature. Suitable compounds for treating or reacting with starch or starch derivatives shall be known to the skilled person. By way of example, one preferred suitable compound is octenyl succinic anhydride (OSA). Due to the hydrophobic and steric properties of OSA, OSA-modified starch displays a highly branched macromolecular structure, which, without wishing to be bound to theory, is understood to lead to desirable stabilising, interfacial and rheological properties.

In the following description, the invention will be described with reference to a flavour release component formed of a flavour delivery material that provides sustained release of a flavour composition. However, the teaching can also be applied to a material for the sustained released of an alternative liquid composition.

The term "sustained release" is used to indicate that the flavour delivery material is capable of releasing the flavour composition over a range of applied compressive force, over a range of deformation of the material, or both. For example, if the release of the flavour composition as a function of the applied compressive force is measured, it will be seen that the material is capable of releasing the flavour composition at a force of x Newtons and will continue to release progressively more of the flavour composition as the force is increased from x Newtons to (x+y) Newtons (for example, where y is 5 Newtons).

Because they are ranges, the ranges of force and deformation described herein have a width and they extend between the ends of the ranges. For example, using the generic example above where y is 5 Newtons, the range of force would have a width of 5 Newtons and it would extend from x Newtons to (x+5) Newtons.

Since increasing the compressive force over the range of force will release further flavour composition from the flavour delivery material, the term "sustained release" can also be described as "progressive release". This is in contrast to prior art flavour release mechanisms for smoking articles in which flavour is released at a particular force, but flavour is not released prior to or after the particular force. For example, the sustained release flavour delivery profile provided by the flavour release component of the invention is in contrast to the flavour delivery profile of a capsule. Capsules are typically manufactured such that the outer shell of the capsule will break at a specific, defined compressive force. At that specific force, the outer shell will be crushed and substantially all of the flavourant contained within the core of the capsule will be released at the same time. However, at applied forces below that specific force, substantially no flavour will be released.

The flavour release component of the smoking articles of the present invention retains the flavour composition within the structure of the flavour delivery material until a compressive force is applied to the component. To achieve such retention of the flavour composition, the flavour delivery material comprises a closed matrix or network structure, which traps the flavour composition within the closed structure. That is, the flavour composition is trapped in domains within a matrix structure. Upon compression of the material, the flavour composition is forced out from the matrix structure, for example, through the breakage of the surrounding structure.

The closed matrix structure of the flavour delivery material comprises a three-dimensional structural polymer matrix that forms a network defining the plurality of domains. The term "domain" is used throughout the present specification to refer to the closed pores or pockets that contain the flavour composition or the distinct regions or, for certain manufacturing processes for matrix materials, droplets of the flavour composition that are dispersed within the precursor materials of the polymer matrix, as further described below. The flavour composition is dispersed through the polymer matrix in a plurality of discrete domains which are surrounded and enclosed by the polymer matrix.

The polymer matrix of the flavour delivery material isolates the flavour composition so that the flavourant is substantially retained within the structure of the polymer matrix until the flavour delivery material is compressed. Compression of the flavour delivery material results in deformation of the polymer matrix. As the level of applied force, deformation, or both force and deformation increases, the matrix is gradually broken down and the domains begin to rupture, such that the flavour composition retained within the domains is released.

Preferably, the flavour delivery material is encapsulated by a frangible outer shell, as defined above. Upon initial compression of the flavour release component, the outer shell will be broken and only after breakage of the outer shell will the applied compressive force be transferred to the inner core of flavour delivery material to release the flavour composition. As described in more detail below, the breakdown of the outer shell upon compression may be felt by the consumer and will typically produce an audible sound. The consumer is therefore advantageously provided with a sensory indication of the activation of the flavour delivery material to release flavour into the smoking article. In particular, in the flavour release components of smoking articles according to the invention, the structure of the flavour release component as described above provides a unique tactile, audible, or both tactile and audible sensation upon compression wherein a sustained crackle or crunch is exhibited over a range of compression. This is described in more detail below.

The inner core of the flavour release component will typically be softer than the more brittle outer shell. This means that there is less support beneath the outer shell, which may advantageously make it easier for the outer shell to be broken down upon compression of the flavour release element and may additionally enhance any crackling effect provided upon compression. Furthermore, by increasing the softness of the flavour delivery material in the inner core, the flavour delivery material becomes more easily compressed once the harder outer region has been broken down, thereby facilitating the release of the flavour composition upon sustained compression of the flavour release component.

The frangible outer shell provides an impermeable layer around the inner core of the flavour delivery material, which improves the retention of the flavour composition within the flavour delivery material during storage and protects the flavour delivery material from moisture and humidity in the surrounding environment. The outer shell further provides the flavour release component with a higher resistance to the mechanical forces to which the component may be subjected during processing. This advantageously reduces the risk of undesired deformation or breakage of the flavour release component during manufacture or the assembly of the smoking articles, thereby facilitating the processing of the flavour delivery material.

The novel tactile sensation provided by the flavour release component of smoking articles according to the invention, as described above, is demonstrated in a "force/displacement test" in which the compression of the smoking article including the component upon the application of an increasing force to the smoking article is measured. The "compression" of the smoking article corresponds to the distance moved by the component of the apparatus applying the force, which will equal the reduction in the dimension of the smoking article in that direction. The force is applied to the portion of the smoking article incorporating the flavour release component, with the force centred at the position of the centre of mass of the flavour release component.

It will be understood that the compressive force is applied to the flavour release component through the surrounding materials of the region of the smoking article in which the component is incorporated. Initially, the compressive force applied in the force/displacement test may deform only the material of the smoking article around the flavour release component rather than the component itself. At a certain level of compression, depending on the type of material surrounding the flavour release component and the size of the flavour release component, the flavour release component will begin to be compressed.

The force/displacement test for the flavour release components according to the invention is carried out with the flavour release component provided within a conventional cellulose acetate tow filter of a smoking article.

The force/displacement test produces a "force/displacement curve", which refers to a graph plotting the variation in the measured compression distance (in the direction of the applied force) as a function of the applied force. In the following description, it is assumed that the force/displacement curve is plotted with compression in millimetres on the x-axis and force in Newtons on the y-axis.

For the purposes of the present invention, the force/displacement test can be conducted using the TA-XT.plus Texture Analyser from Stable Micro Systems. On such a machine, the test speed is about 10 mm per minute. The apparatus includes a moving cylindrical head for applying the force to the smoking article, which has a flat end surface at the bottom end for contacting the smoking article during the test. The flat end surface is circular and has a surface area of about 78.54 square millimetres, corresponding to a 5 mm radius. The force/displacement test is conducted at a temperature of approximately 22 degrees Celsius at a relative humidity of approximately 60 percent.

As defined above, the force/displacement curve produced during the force/displacement test on a smoking article according to the invention displays a plurality of local minima in the force level over a portion of the curve corresponding to a range of compression of at least 1 mm. This means that the highest level of compression at which a local minimum is measured is at least 1 mm greater than the lowest level of compression at which a local minimum is measured, such that a number of force drops are measured within a region of the force/displacement curve starting at a compression distance of x mm and ending at a compression distance of y mm, where y-x is greater than 1 mm. Preferably, the range of compression over which the plurality of local minima in the force level are observed is greater than about 1.5 mm, more preferably greater than about 2.0 mm. Alternatively or in addition, the range of compression over which the plurality of local minima in the force level are observed is preferably less than about 3.0 mm, preferably less than about 2.5 mm.

Each of the "local minima" corresponds to a drop in the force level at a particular compression distance. After each drop, the force level continues to rise in a continuous manner until the next local minimum. Each of the local minima corresponds to a reduction in the force level of at least 1 Newton, wherein the "reduction" corresponds to the difference between the minimum force level at the local minimum and the maximum force level immediately prior to the local minimum.

The force/displacement curve produced by a smoking article according to the invention incorporating the flavour release component described above is in contrast to the force/displacement curve produced by a smoking article of a corresponding construction incorporating a breakable capsule in place of the flavour release component. In the case of a smoking article incorporating a capsule, the force level is seen to rise continuously with increasing compression until the break force of the capsule is reached and the capsule is broken, at which point a large drop in the force level is observed. The force/displacement curve therefore includes a single drop in the force level corresponding to the breakage of the capsule, which essentially defines one maximum peak on the curve. In the case of a smoking article including a conventional filter segment without any flavour release component, no force drop is usually observed during the test.

During the force/displacement test on smoking articles according to the invention, the plurality of local minima in the force level are obtained as the frangible outer shell or other outer structure of the flavour release component is gradually broken down with sustained compression. Unlike with a capsule, where the outer shell breaks at a single, specific force level, in the flavour release component of smoking articles according to the invention, the outer shell is broken down over a range of compression, with each drop in the force level corresponding to the breakdown of a part of the structure of the outer shell.

During compression of the flavour release component within the smoking article by the consumer, the flavour release component will exhibit similar behaviour to that described above in the force/displacement test as the level of compression is increased and the consumer will typically be able to detect the drops in the force level, resulting in a crunchy tactile sensation.

The local minima in the force level are typically observed in a random pattern. However, the pattern of the local minima in the force level, for example, the number or frequency, has been found to affect the tactile sensation provided upon compression of the flavour release component and in particular, the perceived crunchiness of the outer shell. The observed pattern will typically vary according to the specific composition and structure of the flavour release component.

Preferably, the total number of the local minima in the force level over a range of compression of about 2 mm or less is at least about 4, more preferably at least about 6, most preferably at least about 8.

Preferably, at least about 2 local minima, and more preferably at least about 5 local minima in the force level are detected per mm of compression in the force/displacement curve, within the region of the force/displacement curve over which the local minima are observed.

Preferably, at least one local minimum, and more preferably at least about 2 local minima per second are detected in the force/displacement curve, upon compression of the liquid release component within the smoking article at a rate of 10 mm per minute.

Preferably, the region of the force/displacement curve over which the local minima in the force level are observed extends over a range of compression corresponding to at least about 20 percent of the dimension of the uncompressed liquid release component in the direction of the applied force in the force/displacement test, more preferably at least about 30 percent and most preferably at least about 40 percent.

Alternatively or in addition, the region of the force/displacement curve over which the local minima in the force level are observed preferably extends over a range of compression corresponding to less than about 70 percent of the dimension of the uncompressed liquid release component in the direction of the applied force in the force/displacement test, more preferably less than about 60 percent.

Preferably, the region of the force/displacement curve over which the local minima in the force level are observed extends over a range of compression corresponding to at least about 10 percent of the diameter of the uncompressed smoking article in the direction of the applied force and at the position of the liquid release component, more preferably at least about 20 percent.

Alternatively or in addition, the region of the force/displacement curve over which the local minima in the force level are observed preferably extends over a range of compression corresponding to less than 40 percent of the diameter of the uncompressed smoking article in the direction of the applied force and at the position of the liquid release component, more preferably less than about 30 percent.

Preferably, the first local minimum in the force level is observed at a compression distance corresponding to at least about 50 percent of the dimension of the liquid release component in the direction of the applied force in the force/displacement test being applied to the smoking article, more preferably at least about 55 percent. This indicates that the smoking article is preferably compressed by a distance corresponding to at least one half of the dimension of the liquid release component before the compressive force is transferred to the liquid release component at a sufficient level to begin to break apart the outer shell. As described above, the initial compression of the smoking article corresponds to the compression of the material surrounding the liquid release component, for example, the filtration material.

Preferably, the first local minimum in the force level is observed at a compression distance corresponding to at least about 25 percent of the diameter of the smoking article in the direction of the applied force and at the position of the liquid release component, more preferably at least about 30 percent.

Preferably, the first local minimum in the force level is observed at a compression distance corresponding to at least about 2 mm, more preferably at least about 2.5 mm, for example for a smoking article having a diameter of between about 7.5 mm and about 8 mm.

In addition to, or as an alternative to the tactile sensation that can be provided by the flavour release component of the smoking articles according to the invention, the flavour release components can also provide a novel audible sensation. This audible sensation may also be demonstrated in the force/displacement test by measuring the acoustic signal released from the smoking article during the force/displacement test. The "acoustic signal" refers to a graph plotting the acoustic level of the sound released from the sample during the force/displacement test as a function of the compression distance. In the following description, it is assumed that the acoustic signal is plotted with compression in millimeters on the x-axis and the acoustic level in decibels on the y-axis.

Advantageously, the acoustic signal can be plotted together with the force level as a function of compression in order to analyse the correlation between the acoustic emission from the smoking article and the pattern of the local minima in the force level.

For the purposes of the present invention, the acoustic signal may be obtained by connecting an Acoustic Envelope Detector from Stable Micro Systems to the Texture Analyser apparatus described above. The acoustic envelope detector uses a microphone placed proximate the test sample to measure the sound generated from the sample during the force/displacement test. The microphone is positioned above the smoking article, with the axis of the microphone directed at an angle of about 35 degrees to the longitudinal axis of the smoking article and with the end of the microphone 25 mm away from the point at which the centre of the head of the apparatus contacts the smoking article to apply the compressive force. The microphone detects sound above a decibel level of 25 decibels and provides a sample rate of at least 200 samples per second.

The acoustic signal generated during the force/displacement test on smoking articles according to the invention includes an initial phase at low compression distances in which the acoustic level is substantially constant. This initial phase is observed before a sufficient level of compression is provided to start breaking down the outer structure of the flavour release component. Where the flavour release component is placed in a portion of the filter, the initial phase may include a low level acoustic signal that is caused by compressing the filter before the flavour deliver release component is reached. For example, the low level acoustic signal can be generated by filtration material placed around the flavour release component, as described further below. Above a certain compression level, as the outer shell or other outer structure begins to break down, acoustic events are observed within the acoustic signal, where an "acoustic event" refers to a change in the acoustic signal relative to the base line level observed in the initial phase described above.

Preferably, the acoustic signal detected upon compression of the liquid release component during the force/displacement test is sustained above 55 decibels over a range of compression of at least 1 mm. This acoustic level typically corresponds to an increase of several decibels relative to the base line level measured during the initial phase. The acoustic signal therefore shows a sustained increase in the acoustic level over a range of compression. It is thought that this is due to an increased level of sound released from the flavour release component and the surrounding material of the smoking article as the compression of the smoking article begins to breakdown the structure of the outer shell of the flavour release component.

Preferably, two or more of the local minima in the force level, as described above, occur within the range of compression during which the acoustic signal is sustained above 55 decibels. The sustained increase in the acoustic signal therefore coincides with at least a part of the breakdown of the structure of the outer shell of the flavour release component.

Alternatively or in addition to the sustained decibel level defined above, the acoustic signal detected upon compression of the flavour release component during the force/displacement test comprises an elevated phase in which a plurality of acoustic peaks having an elevated decibel level of at least about 65 decibels are detected, wherein the elevated phase extends over a range of compression of at least about 1.0 mm, more preferably at least about 1.5 mm, more preferably at least about 2.0 mm. Preferably, at least 50 percent of the acoustic peaks within the elevated phase have an elevated decibel level of at least 75 decibels.

Within the elevated phase of the acoustic signal, a plurality of discrete, audible sounds is therefore produced as the compression of the flavour release component increases, with each peak corresponding to a breakdown in part of the structure of the outer shell as it is gradually broken apart. This emission of a plurality of acoustic peaks provides a crackling or crunchy sound, which is sustained as compression is applied to the flavour release component.

The acoustic signal produced by a smoking article according to the invention incorporating the flavour release component described above is in contrast to the acoustic signal produced by a smoking article of a corresponding construction incorporating a breakable capsule in place of the flavour release component. In the case of a smoking article incorporating a capsule, the acoustic level is seen to remain relatively constant until the capsule is broken, at which point a large single peak in the acoustic signal is observed. In the case of a smoking article including a conventional filter segment without any flavour release component, no acoustic peaks having a decibel level above 65 decibels are usually observed during the test.

In preferred embodiments of the invention, at least one of the acoustic peaks coincides with one of the plurality of local minima in the force level. Particularly preferably, most or all of the acoustic peaks coincide with one of the plurality of local minima in the force level, such that the pattern of the local minima substantially coincides with the pattern of acoustic peaks. This demonstrates the correlation between the acoustic peaks and the drops in the force level, indicating that both are caused by the same event, namely a structural breakdown in the outer shell. This correlation means that both a tactile and a corresponding audible sensation will be experienced by the consumer as the outer shell is broken down upon the compression of the flavour release component.

The elevated phase of the acoustic signal including the plurality of acoustic peaks may optionally encompass a region where the detected decibel level is sustained above 55 decibels over a range of compression of at least 1 mm, as described above. In such embodiments, one or more of the acoustic peaks may occur within the sustained region of the acoustic signal, prior to the sustained region, after the sustained region, or a combination thereof.

During the elevated phase, the acoustic peaks are emitted in a random pattern. However, the pattern of the acoustic peaks in the elevated phase of the acoustic signal, for example, the number or frequency, has been found to affect the perceived crunchiness of the outer shell. The observed pattern will typically vary according to the specific composition and structure of the flavour release component.

Preferably, the total number of the acoustic peaks detected within the elevated phase is at least about 4, more preferably at least about 6, most preferably at least about 8.

Preferably, at least about 2 acoustic peaks, more preferably at least about 5 acoustic peaks are detected per mm of compression within the elevated phase.

Preferably, at least one acoustic peak per second, more preferably at least two acoustic peaks per second are detected within the elevated phase upon compression of the liquid release component within the smoking article at a rate of 10 mm per minute.

Preferably, the elevated phase of the acoustic signal within which the acoustic peaks are emitted extends over a range of compression corresponding to at least about 20 percent of the dimension of the liquid release component in the direction of the applied force in the force/displacement test, more preferably at least about 30 percent and most preferably at least about 40 percent. Alternatively or in addition, the elevated phase of the acoustic signal preferably extends over a range of compression corresponding to less than about 70 percent of the dimension of the liquid release component in the direction of the applied force in the force/displacement test, more preferably less than about 60 percent.

Preferably, the elevated phase of the acoustic signal extends over a range of compression corresponding to at least about 10 percent of the diameter of the smoking article in the direction of the applied force and at the position of the liquid release component, more preferably at least about 20 percent. Alternatively or in addition, the elevated phase of the acoustic signal preferably extends over a range of compression corresponding to less than 40 percent of the diameter of the smoking article in the direction of the applied force and at the position of the liquid release component, more preferably less than about 30 percent.

Preferably, the elevated phase begins at a compression distance corresponding to at least about 50 percent of the dimension of the liquid release component in the direction of the applied force in the force/displacement test, more preferably at least about 55 percent. This corresponds to the compression distance at which the first acoustic peak is measured.

Preferably, the elevated phase begins at a compression distance corresponding to at least about 25 percent of the diameter of the smoking article in the direction of the applied force and at the position of the liquid release component, more preferably at least about 30 percent.

Preferably, the elevated phase begins at a compression distance corresponding to at least about 2 mm, more preferably at least about 2.5 mm, for example for a smoking article having a diameter of between about 7.5 mm and about 8 mm.

Preferably, the frangible outer shell of the flavour release components of smoking articles according to the invention comprises at least one film-forming polymer and at least one plasticiser. This combination of materials has been found to provide a brittle coating which is broken down upon compression of the flavour release component to produce a tactile and audible effect as described above, with a sustained cracking or crunching of the outer shell.

The frangible outer shell may comprise a single film-forming polymer or a combination of two or more film-forming polymers.

Suitable film-forming polymers would be known to the skilled person but include, for example, shellac, paraffin, polyvinylpyrrolidone, cocoa butter, waxes including but not limited to beeswax, carnauba wax and candellia wax, proteins including but not limited to gluten, caseins, whey proteins, gelatin, cotton seed proteins and zein, gums including but not limited to gum arabic, locust bean gum, tara gum, guar gum, gum tragacanth, gum karaya and mesquite gum, galactomannans, gellan, alginate, pectin, carrageenan, sucrose, fructose, cellulose, hydroxypropyl methylcellulose, hydroxypropyl cellulose, methyl hydroxypropyl cellulose, methylcellulose, ethyl methylcellulose, carboxymethyl cellulose, nitrocellulose, alpha glucan, beta glucan, starch, modified starch, amylase, amylopectin, maltodextrins, dextrins, cyclodextrin, polydextrose, xanthan, chitosan and combinations thereof. Preferably, the outer shell includes at least one film-forming polymer which is a non-polysaccharide polymer.

In certain preferred embodiments of the invention, the outer shell comprises a polyester film-forming polymer. The polyester film-forming polymer could be of natural or synthetic origin, but is preferably a natural polyester film-forming polymer and particularly preferably shellac. Compounds of natural origin are those that can be obtained via a purification process from a plant or animal source, and compounds that are synthetic are synthesised via an industrial chemical process.

In other preferred embodiments of the invention, the outer shell comprises a cellulosic film-forming polymer, particularly preferably methyl hydroxypropyl cellulose.

In further preferred embodiments of the invention, the outer shell comprises both a polyester film-forming polymer and a cellulosic film-forming polymer. For example, in a particularly preferred embodiment of the invention the outer shell comprises a combination of shellac and methyl hydroxypropyl cellulose.

In other preferred embodiments, the outer shell comprises at least one starch based film-forming polymer, particularly preferably a starch or modified starch, such as corn starch. Preferably, the starch based film-forming polymer is provided in combination with at least one non-starch film-forming polymer. Particularly preferably, the starch based film-forming polymer is used in combination with a polyester film-forming polymer, a cellulosic film-forming polymer or a combination thereof. For example, in a particularly preferred embodiment of the invention the outer shell comprises a combination of shellac and corn starch or a combination of methyl hydroxypropyl cellulose and corn starch.

Preferably, the outer shell comprises at least about 80 percent by weight of the one or more film-forming polymers, more preferably at least about 85 percent by weight, most preferably at least about 90 percent by weight based on the total dry weight of the outer shell.

Alternatively or in addition, the outer shell preferably comprises less than about 98 percent by weight of the one or more film-forming polymers, more preferably less than about 96 percent by weight, based on the total dry weight of the outer shell.

For example, preferably, the outer shell comprises between about 80 percent by weight and about 98 percent by weight, more preferably between about 85 percent by weight and about 96 percent by weight, more preferably between about 90 percent by weight and 96 percent by weight of the one or more film-forming polymers, based on the total dry weight of the outer shell.

Suitable plasticisers for use in the outer shell would be known to the skilled person. Examples of suitable classes of plasticisers are saccharides (mono-, di- or oligo-saccharides), alcohols, polyols, acid salts, lipids and derivatives (such as fatty acids, monoglycerides, esters, phospholipids) and surfactants. Specific examples of suitable plasticisers include but are not limited to: glucose, fructose, honey, xylitol, sorbitol, polyethylene glycol, glycerol, propylene glycol, lactitol, sodium lactate, hydrated hydrolyzed starches, trehalose, or combinations thereof. In particularly preferred embodiments, the plasticiser comprises xylitol, glycerol, or a combination thereof.

Preferably, the outer shell comprises less than about 15 percent by weight, more preferably less than about 12 percent by weight and most preferably less than about 10 percent by weight of the one or more plasticisers. Alternatively or in addition, the outer shell preferably comprises at least about 2 percent by weight of the one or more plasticisers, more preferably at least about 4 percent by weight, based on the total dry weight of the outer shell. For example, the outer shell preferably comprises between about 2 percent and about 15 percent by weight, more preferably between about 4 percent and about 12 percent by weight, more preferably between about 4 percent and about 10 percent by weight of the one or more plasticisers, based on the total dry weight of the outer shell.

Preferably the outer shell has a thickness of at least about 25 microns, more preferably at least about 50 microns. Alternatively or in addition, the thickness of the outer shell is preferably less than about 500 microns, more preferably less than about 300 microns, most preferably less than about 200 microns. For example, the thickness of the outer shell is preferably between about 25 microns and about 500 microns, more preferably between about 50 microns and about 300 microns, most preferably between about 50 microns and about 200 microns. The thickness will typically vary around the outer shell but preferably the thickness falls within the desired range across substantially the entire surface. The thickness of the coating layer may be measured from an SEM image taken through a cross-section of the flavour release component, at a number of positions around the outer shell. The thickness measured at all positions should fall within the preferred range.

Preferably, the average thickness of the outer shell corresponds to at least about 2 percent of the maximum dimension of the inner core, more preferably at least about 5 percent.

Preferably, the average thickness of the outer shell corresponds to less than about 6 percent of the maximum dimension of the inner core.

Preferably, the outer shell corresponds to at least about 5 percent by weight of the flavour release component, more preferably at least about 10 percent by weight, most preferably at least about 15 percent by weight, based on the total dry weight of the flavour release component. Alternatively or in addition, the outer shell preferably corresponds to less than about 30 percent by weight, more preferably less than about 25 percent by weight, based on the total dry weight of the flavour release component. For example, the outer shell preferably corresponds to between about 5 percent and about 30 percent by weight, more preferably between about 10 percent and about 25 percent, more preferably between about 15 percent and about 25 percent by weight, based on the total dry weight of the flavour release component.

As described above, the flavour delivery material forming the inner core of flavour release components of the present invention is formed of a closed matrix structure defining a plurality of domains within which is trapped a liquid flavour composition. The closed matrix structure comprises a polymer matrix formed of one or more cross-linked polymers. Preferably, the polymer matrix is provided by one or more polysaccharides and particularly preferably, one or more anionic polysaccharides. In such embodiments, the cross-linking of the polymer matrix is preferably achieved through reaction of the polysaccharides with multivalent cations which form salt bridges to cross-link the polysaccharides.

The term "anionic polysaccharide" is used throughout the present specification to refer to a polysaccharide having a net negative charge. Preferred anionic polysaccharides for use in the present invention include but are not limited to alginate and pectin.

In relation to the present invention, the term "multivalent cation" is used to describe a positively charged ion having a valence greater than 1, for example, bivalent or trivalent cations. The multivalent cations are preferably provided in the form of a solution of a multivalent metal salt, such as a solution of a metal chloride. Preferred multivalent cations include calcium, iron, aluminium, manganese, copper, zinc or lanthanum. A particularly preferred cation is bivalent calcium ($Ca^{2+}$).

The closed matrix structure of the flavour delivery material of the present invention preferably further comprises a filler within the polymer matrix, wherein the filler comprises one or more amphiphilic polysaccharides. The term "amphiphilic polysaccharide" is used throughout the present specification to refer to a polysaccharide having a hydrophilic portion and a hydrophobic portion. In the flavour delivery material of the present invention, the one or more amphiphilic polysaccharides are incorporated within the polymer matrix but have minimal or no ability to cross-link with themselves or the one or more polysaccharides forming the polymer matrix.

Preferably, the one or more amphiphilic polysaccharides of the filler are chemically modified to be amphiphilic.

It has been found that the inclusion of the filler within the polymer matrix affects the structure of the flavour delivery material. In the flavour delivery material of the present invention, the structure of the polymer matrix varies from the outside of the material towards the centre. In particular, the flavour delivery material comprises a polymer rich outer region, which has a relatively high proportion of the cross-linked polymer matrix, and a flavourant rich core region, which has a relatively high proportion of the flavourant. This structure arises due to the interaction of the hydrophilic solution of polysaccharides with the hydrophobic flavour composition, which will tend to cause the hydrophobic flavour composition to aggregate within a core region upon the formation of a drop of the emulsion of the two components.

The cross-linking of the polysaccharides occurs when an emulsion of the flavour composition within a solution of the polysaccharides is dropped into a multivalent cation cross-linking solution. As described above, there is preferably a greater degree of cross-linking in the polymer rich outer region than in the flavourant rich core region. This is reflected by a gradient in the concentration of multivalent cations within the closed matrix structure, wherein the concentration of multivalent cations is highest in the outer region of the flavour release component where the degree of cross-linking is highest and decreases towards the inner, core region of the flavour release component as the proportion of polymer matrix decreases.

The greater degree of cross-linking in the polymer rich outer region of the flavour delivery material increases the hardness of the polymer matrix. The outer region of the flavour release component is therefore harder and has a lower concentration of the flavour composition than the core region.

The inclusion of the filler within the polymer matrix has been found to result in an enhanced gradient in the concentration of multivalent cations between the outer region of the flavour delivery material and the core region. It is thought that the amphiphilic filler prevents the complete equalisation of the concentration of the multivalent cations from the outer surface through the emulsion so that a greater degree of cross-linking occurs in the outer region compared to the core region. This increases the hardness of the outer region whilst decreasing the hardness of the core region, which in turn provides a further improvement in the retention of the flavour composition within the core region.

Furthermore, the increased level of cross-linking in the polymer matrix within the outer region of the flavour delivery material provides a harder 'layer' around the outside of the material that is relatively brittle and can crackle or crunch upon initial compression of the inner core, after the breakdown of the outer shell but prior to the release of the flavour composition. This effect can be used to enhance the tactile and audible sensation provided to the consumer upon compression of the flavour release component.

Preferably, the gradient in the concentration of multivalent cations within the closed matrix structure of the inner core of the flavour release component is such that along a line extending through the inner core from the outer surface of the closed matrix structure to the centre of mass of the inner core, the highest concentration of multivalent cations within 250 microns from the outer surface of the closed matrix structure is at least about 1.5 times the highest concentration of multivalent cations within 500 microns from the centre of mass.

Preferably, along the line extending through the inner core from the outer surface of the closed matrix structure to the centre of mass of the inner core, the highest concentration of multivalent cations within 250 microns from the outer surface of the closed matrix structure is at least about 1.75 times and more preferably at least about twice the highest concentration of multivalent cations within 500 microns from the centre of mass.

Further, the inner core preferably has a minimum dimension between the outer surface of the closed matrix structure and the centre of mass of the liquid release component that is at least 1.5 mm, more preferably at least 2.0 mm.

Preferably, the gradient in the concentration of multivalent cations within the closed matrix structure of the inner core of the flavour release component is such that along a line extending through the inner core from the outer surface of the closed matrix structure to the centre of mass of the inner core, the highest concentration of multivalent cations within 250 microns from the outer surface of the closed matrix structure is at least about 1.5 times the highest concentration of multivalent cations within 250 microns from the centre of mass.

Preferably, along the line extending through the inner core from the outer surface of the closed matrix structure to the centre of mass of the inner core, the highest concentration of multivalent cations within 250 microns from the outer surface of the closed matrix structure is at least about 1.75 times and more preferably at least about twice the highest concentration of multivalent cations within 250 microns from the centre of mass.

Further, the flavour release component preferably has a minimum dimension between the outer surface of the closed matrix structure and the centre of mass of the inner core that is at least 1.5 mm, more preferably at least 2.0 mm.

For the purposes of the present invention, the gradient in the concentration of multivalent cations within the flavour delivery material forming the inner core of the flavour release component is quantified by measuring the concentration along a line extending through the inner core from the outer surface of the closed matrix structure to the centre of mass of the inner core. The measurements may be taken by extracting a sample or core from the inner core of the flavour release component which extends from the outer surface through the centre of mass and forming a plurality of sections by making transverse cuts at a number of positions along the sample or core. Here the term "transverse cuts" is used to mean that the sections are formed by cutting into the sample or core transversely to a longitudinal axis of the sample or core, that is transversely to the line extending through the inner core of the flavour release component from the outer surface of the closed matrix structure to the centre of mass of the inner core. For each section, the concentration of multivalent ions may be measured using a mass spectrometry technique. The outer shell provided around the inner core of flavour delivery material should be disregarded so that measurement of the calcium gradient begins at the outer surface of the closed matrix structure.

By measuring the calcium concentration in a plurality of sections along the core, the highest concentration within 250 microns from the outer surface of the closed matrix material and the highest concentration within 500 microns from the centre of mass of the inner core may identified. Other suitable techniques for measuring the gradient in the concentration of multivalent cations will also be known to the skilled person. In certain cases, the removal of a sample from the liquid delivery component may be facilitated by freezing the component.

Preferably, the one or more amphiphilic polymers of the filler include at least one selected from starch chemically modified to be amphiphilic and starch derivatives chemically modified to be amphiphilic. A particularly preferred form of chemically modified starch for use in the present invention is octenyl succinic anhydride (OSA) starch. Suitable starch derivatives include but are not limited to maltodextrin, high amylase food starch and combinations thereof.

Alternatively or in addition to the filler, the closed matrix structure may further comprise a plasticiser. Suitable plasticisers are described in WO-A-2013/068304.

The flavour composition of the flavour delivery material forming the inner core of the flavour release component preferably includes a flavourant mixed with one or more fats. Suitable materials for forming the flavour composition of flavour release components according to the invention are described in WO-A-2013/068304. Preferably, the flavour composition comprises menthol, Eugenol, or a combination of menthol or Eugenol as the flavourant.

As described above, the flavour delivery material of the flavour release component of the present invention provides a sustained-release delivery profile, such that the amount of the flavour composition released upon compression of the flavour release component can be controlled through the adjustment of the compressive force applied by the consumer, for example over a range of at least 5 Newtons. This provides greater flexibility in the amount of flavour composition that can be released and therefore greater control over the intensity of flavour that is provided during smoking.

Preferably, the flavour delivery material provides a sustained release of the flavour composition upon compression of the flavour release component over a range of force of at least about 5 Newtons, more preferably at least about 8 Newtons, more preferably at least about 10 Newtons and most preferably at least about 20 Newtons.

Preferably, the flavour delivery material provides a sustained release of the flavour composition upon compression of the flavour release component over a range of force from about 10 Newtons to about 15 Newtons. That is, the range of force preferably extends from about 10 Newtons to about 15 Newtons.

Particularly preferably, the flavour delivery material provides a sustained release of the flavour composition over a broader range of force, for example over a range of force from about 5 Newtons to about 50 Newtons. This could also be described as a range extending from about 5 Newtons to about 50 Newtons. More preferably, the flavour delivery material provides a sustained release of flavour composition over a range of force from about 5 Newtons to about 25 Newtons, most preferably from about 5 Newtons to about 20 Newtons.

Alternatively or in addition to providing a sustained release of the flavour composition upon compression of the flavour release component over a range of force, the flavour delivery material preferably provides a sustained release of the flavour composition upon compression of the flavour release component over a range of deformation of at least 25 percent deformation. That is, the range of deformation has a width of at least 25 percent deformation. The deformation of the material will typically increase with increasing compressive force. The percent deformation of the material corresponds to the reduction in dimension of the material upon application of a compressive force in the direction in which the compressive force is applied. The flavour delivery material is capable of releasing the flavour composition over a range of deformation, which means that the amount of the flavour composition that is released will increase progressively as the deformation increases within a defined range.

The sustained release delivery profile of the flavour delivery material of the flavour release component of the present invention is analogous to that described in WO-A-2013/068304.

The flavour release component as described above may advantageously be incorporated into a wide variety of different types of smoking articles. For example, the flavour release component may be incorporated into combustible smoking articles, such as filter cigarettes, having a rod of tobacco cut filler or other smokable material, which is combusted during smoking.

Alternatively, the flavour release component may be incorporated into heated smoking articles of the type described above in which material is heated to form an aerosol, rather than combusted. For example, the flavour release component may be incorporated into a heated smoking article comprising a combustible heat source, such as that disclosed in WO-A-2009/022232, which comprises a combustible heat source and an aerosol-generating substrate downstream of the combustible heat source. The flavour release component may also be incorporated into heated smoking articles comprising non-combustible heat sources, for example, chemical heat sources or electrical heat sources such as electrical resistive heating elements.

Alternatively, the flavour release component as described above may be incorporated into smoking articles in which a nicotine-containing aerosol is formed from a tobacco material or other nicotine source without combustion and in some cases without heating, such as those described in WO-A-2008/121610 and WO-A-2010/107613.

Smoking articles according to the present invention may incorporate the flavour release component in any one or more of the components of the smoking article. The smoking article component or portion of the component incorporating the flavour delivery material should be deformable, such that a compressive force can be applied to the flavour delivery material through the compression of the component. Preferably, the flavour release component is incorporated into the filter or mouthpiece of the smoking article. The filter or mouthpiece may be compressed in order to apply a compressive force to the flavour delivery material to release the flavour composition into the surrounding filter. During smoking of the smoking article, the flavourant from the portion of the flavour composition that has been released from the flavour delivery material is delivered into the smoke that passes through the filter.

The filter may be a single segment filter, formed of a single segment incorporating the flavour release component. Alternatively, the filter may be a multi-component filter comprising at least one filter segment incorporating the flavour release component and at least one additional filter segment. A variety of suitable filter segments would be well known to the skilled person including but not limited to fibrous filter tows, cavity filter segments, tubular filter segments and flow restrictor segments. One or more of the filter segments may comprise an additional flavour material, a sorbent material, or a combination of a flavour material and a sorbent material.

In certain preferred embodiments of the invention, the flavour release component is incorporated within a segment of a fibrous filtration material, such as cellulose acetate tow. In such embodiments, one or more flavour release components are preferably dispersed through the fibrous filtration material during production of the filter segment such that in the assembled filter, the flavour delivery material is embedded within the segment. Upon compression of the filter and the flavour release component within the filter, the outer shell of the flavour release component is first broken and then the flavour composition is released into the surrounding fibrous filtration material. Advantageously, where the flavour composition comprises a liquid excipient, such as one or more liquid fats, the flavour composition is readily dispersed amongst the fibrous filtration material upon release from the flavour delivery material, as described above. The flavour composition thereby coats the fibres of the filtration material to optimise the transfer of the flavourants into the smoke.

In alternative embodiments of the invention, the flavour release component is incorporated within a cavity in the filter. For example, the flavour release component may be incorporated within a cavity between two filter plugs, wherein the cavity is defined by a filter wrapper surrounding the filter.

Preferably, the flavour release component within the filter is visible to the consumer through the one or more layers of wrapping material circumscribing the filter. Suitable arrangements for providing a filter with visibility of the filter material would be known to the skilled person.

As described above, the form of the flavour release component may vary. Suitable forms for incorporation into a smoking article or filter according to the invention include but are not limited to beads, threads, sheets or flakes. Preferably, the flavour release component is in the form of a bead, which is preferably rounded and particularly preferably, substantially cylindrical or spherical.

The width of the flavour release component may be greater than about 1 mm, preferably greater than about 2 mm, and more preferably greater than about 3 mm. Alternatively or in addition, the width of the flavour release component may be less than about 8 mm, preferably less than about 6 mm, and more preferably less than about 4 mm. Preferably, the width of the flavour release component is between about 1 mm and about 8 mm, more preferably between about 2 mm and about 6 mm, even more preferably between about 3 mm and about 4 mm.

The "width" of the flavour release component corresponds to the maximum dimension of the transverse cross section of the flavour release component, wherein the transverse cross section is the largest section created by a plane cutting across the flavour release component when arranged as intended to be incorporated into a smoking article, the plane being substantially perpendicular to the longitudinal axis of the smoking article. For a substantially spherical bead, the width of the bead substantially corresponds to the diameter of the bead.

Preferably, the dimension of the flavour release component in the direction of the applied force in the force/displacement test corresponds to at least about 30 percent of the diameter of the smoking article in the same direction, at the position of the flavour release component, more preferably at least about 40 percent and more preferably at least about 50 percent. Alternatively or in addition, the dimension of the flavour release component in the direction of the applied force in the force/displacement test preferably corresponds to less than about 75 percent of the diameter of the smoking article in the same direction, at the position of the flavour release component, more preferably less than about 70 percent.

A single flavour release component may be provided within the smoking article, or a plurality of flavour release components may be provided, for example two or more, three or more, or four or more flavour release components. Where a plurality of flavour release components are provided, the flavour release components may be spaced apart along the smoking article, or may be placed in one or more specific regions of the smoking article, for example within the filter. One or more flavour release components of the flavour delivery material can be inserted into the smoking articles according to the invention using known apparatus and methods for inserting objects into filters or tobacco rods.

The flavour release component may be coloured, if desired, through the inclusion of a colourant to the flavour delivery material or the outer shell, or both. Preferably, a colourant is incorporated into the flavour delivery material in order to adjust the colour of the material so that it resembles the colour of the material in the component of the smoking article in which the flavour release component is incorporated. For example, if the flavour release component is incorporated into the tobacco rod of a smoking article, the flavour delivery material may be brown or green in colour. The flavour release component therefore has a low visibility in the tobacco rod.

Smoking articles according to the invention may each include greater than about 1 mg and preferably greater than about 3 mg of any of the flavour delivery materials described herein. Alternatively or in addition, each smoking article may include less than about 20 mg, preferably less than about 12 mg, and more preferably less than about 8 mg of any of the flavour delivery materials described herein. Preferably, each smoking article includes between about 1 mg and about 20 mg, more preferably between about 1 mg and about 12 mg, and most preferably between about 3 mg and about 8 mg of the flavour delivery material.

Preferably, the overall length of smoking articles according to the present invention is between about 70 mm and about 128 mm, more preferably about 84 mm.

Preferably, the external diameter of smoking articles according to the present invention is between about 5 mm and about 8.5 mm, more preferably between about 5 mm and about 7.1 mm for slim sized smoking articles or between about 7.1 mm and about 8.5 mm for regular sized smoking articles.

Preferably, the overall length of the filters of smoking articles according to the present invention is between about 18 mm and about 36 mm, more preferably about 27 mm.

Smoking articles according to the present invention may be packaged in containers, for example in soft packs or hinge-lid packs, with an inner liner coated with one or more flavourants.

According to the invention there is also provided a method for producing the flavour release component as described above. The method comprises the steps of: forming a flavour composition by dispersing a flavourant in one or more fats that are liquid at room temperature (22° C.); mixing the flavour composition with a matrix solution comprising one or more polysaccharides to form an emulsion; adding the emulsion to a cross-linking solution to cross-link the polysaccharides to form an inner core having a polymer matrix including a plurality of domains of the flavour composition; coating the inner core with a coating solution comprising at least one film-forming polymer and at least one polysaccharide filler; and drying the coated inner core to form a flavour release component having a frangible outer shell.

Suitable methods for forming the inner core of flavour delivery material are described in WO-A-2013/068304.

Suitable coating systems for applying the coating solution to the inner core would be known to the skilled person. In certain embodiments, the coating system may be a closed system, for example to enable the provision of vacuum conditions for the coating step. The coating solution is preferably sprayed onto the inner core using suitable spraying means provided within the coating system. Preferably, the coating solution is sprayed onto a plurality of inner cores in a fluidised state, for example in a fluidised bed sprayer, such as the Mini-Glatt system available from Glatt GmbH, Germany. Preferably, the coating solution is applied to the inner core at a temperature of between 40 degrees Celsius and 50 degrees Celsius.

The coated inner core is then dried in order to evaporate any solvent, leaving behind a frangible outer shell on the outer surface of the inner core. The coated inner core is preferably dried in a stream of gas or air.

Figure 2:
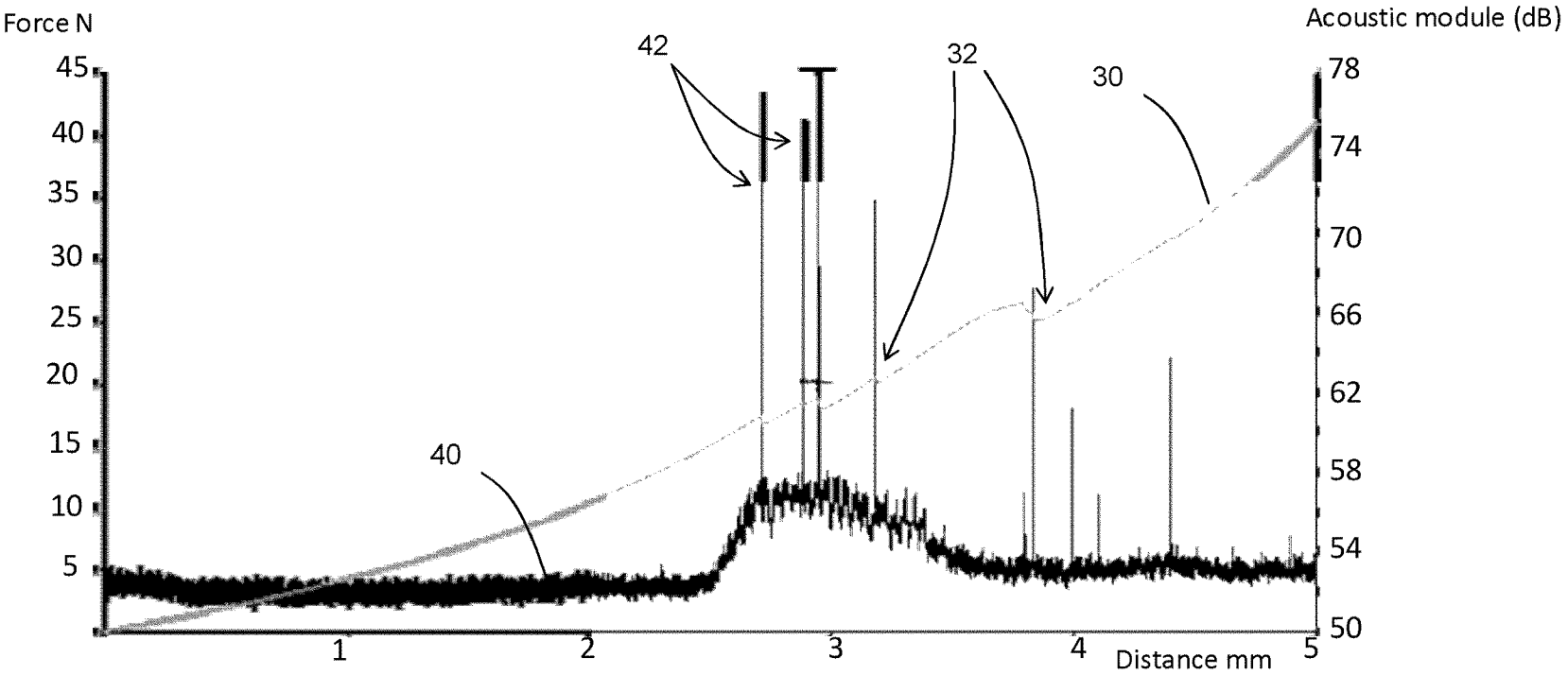

The invention will be further described, by way of example only, with reference to the accompanying figures in which:

FIG. 1 shows a side view of a filter cigarette according to the present invention comprising a flavour release component in the filter; and FIG. 2 shows the force/displacement curve and acoustic signal obtained during a force/displacement test on the smoking article of FIG. 1.

The cigarette 10 shown in FIG. 1 comprises an elongate, cylindrical wrapped tobacco rod 12 attached at one end to an axially aligned, elongate, cylindrical filter 14. The filter 14 includes a single segment of cellulose acetate tow. The wrapped tobacco rod 12 and the filter 14 are joined in a conventional manner by tipping paper 16, which circumscribes the entire length of the filter 14 and an adjacent portion of the wrapped tobacco rod 12. To mix ambient air with mainstream smoke produced during combustion of the wrapped tobacco rod 12, a plurality of annular perforations 18 are provided through the tipping paper 16 at a location along the filter 14.

A single flavour bead 20 formed of a coated flavour delivery material, as described above, is provided centrally within the filter 14. The flavour bead 20 has a diameter of around 4 mm and has a structure comprising an inner core of flavour delivery material and a frangible outer shell around the inner core. The flavour delivery material in the bead 20 incorporates a flavour composition comprising a menthol flavourant, which is released upon compression of the material with a force of between about 5 Newtons and about 10 Newtons. After compression, the menthol flavourant is available for release into the mainstream smoke as the smoke passes through the filter during smoking.

The amount of flavour composition released from the flavour delivery material depends upon the applied compressive force such that the flavour intensity can be controlled through control of the pressure applied to the filter. The flavour bead can be compressed one or more times prior to or during smoking in order to provide a burst of menthol flavour to the smoke.

Examples of suitable formulations for the flavour bead and a process for forming the flavour bead are set out below.

EXAMPLE 1

The inner core of the flavour bead is formed of a flavour delivery material comprising a cross-linked alginate matrix with a plurality of domains of a menthol flavour composition dispersed through the matrix. To produce the inner core of flavour delivery material, the menthol flavour composition is first formed from a mixture of the following components:

| Component | Amount (weight percent) |
|---|---|
| Natural L-menthol | 26.07 |
| MCT Oil (MYGLIOL 810) | 72.05 |
| Other flavour | 1.88 |

The mixing is conducted with magnetic agitation at a temperature of 30 degrees Celsius for a period of 20 minutes.

A matrix solution is then formed from a mixture of the following components:

| Component | Function | Amount (weight percent) |
|---|---|---|
| Sodium alginate | Anionic polysaccharide | 2.36 |
| OSA-modified corn starch | Amphiphilic polysaccharide filler | 0.67 |
| Glycerol | Plasticiser | 0.34 |
| Sorbitol | Plasticiser | 0.34 |
| Water | Solvent | 96.29 |

As the amphiphilic polysaccharide filler, OSA-modified corn starch HICAP™ 100 (commercially available from National Starch & Chemical, Manchester UK) is used. HICAP™ 100 is an OSA-modified starch derived from waxy maize. Due to the hydrophobic and steric properties imparted by OSA, HICAP™ 100 is structurally significantly different from a natural starch, such as Merizet® 100 starch (commercially available from Tate & Lyle), and displays, accordingly, different chemical-physical properties, including in particular interfacial and rheological properties.

The mixing is conducted with a marine impeller operating at 1500 revolutions per minute and at a temperature of less than 30 degrees Celsius. The mixing is continued for 30 minutes.

A solution then is formed with 30 percent w/w of the flavour composition and 70 percent w/w of the matrix solution. The solution is mixed in a shear mixer, such as a Polytron 3100B, available from Kinematica. The solution is subjected to high shear at an RPM of 15000 to 20000 whilst maintaining the mixture at a temperature of 52-55 degrees Celsius. The mixing is continued for 3 to 4 minutes to produce an emulsion of the flavour composition in the matrix polymer solution in which the size of the flavour composition droplets is reduced to below about 10 to 50 microns.

The emulsion is then added to a cross-linking solution of the following composition to form the polymer matrix having the plurality of domains.

| Component | Amount (weight percent) |
|---|---|
| Calcium chloride | 5.0 |
| Water | 95.0 |

The emulsion is dripped into a bath of the cross-linking solution to form a flavour delivery material in the form of spheres which provide the inner core of the flavour beads. The emulsion is added drop-by-drop through a nozzle using a peristaltic pump. The emulsion is dropped through a 5 millimetre nozzle at a flow rate of 500 grams per hour. The process is carried out at room temperature and the bath of cross-linking solution is agitated using a magnetic mixer at a speed of 100 revolutions per minute. The emulsion and the cross-linking solution are allowed to react for a period of ten minutes.

The inner cores are then removed from the cross-linking solution and washed in deionised water before being dried in a stream of dried air at a temperature of about 25 degrees Celsius for at least 360 minutes.

The number average weight of each inner core of flavour delivery material is 29.1 milligrams and the number average diameter of each bead is 3.94 mm. The average water content of each bead is between about 4 percent and about 6 percent by weight and the average menthol content of each bead is approximately 20 to 25 percent by weight.

Once dried, the inner cores are coated with a coating solution formed of an aqueous solution of the following mixture of compounds in water:

| Component | Function | Amount (weight percent) |
|---|---|---|
| Shellac | Film-forming polymer | 72.0 |
| Corn starch | Film-forming polymer | 19.9 |
| Xylitol | Plasticiser | 4.8 |
| Glycerol | Plasticiser | 3.3 |

The solution contains about 30 percent by weight of the compounds above and 70 percent by weight of water. The mixing of the coating solution is conducted with magnetic agitation at a temperature of 30 degrees Celsius for a period of 20 minutes.

The coating solution is then applied to the inner cores in a Mini Glatt fluidised bed sprayer with an air temperature of 40-45 degrees Celsius, an atomisation pressure of 3 Bar and a liquid flow rate of 8 gram per minute for 5 minutes. The amount of the liquid coating solution applied to the fluidised inner cores corresponds to about 25 percent by weight of the total weight of the inner cores.

The solvent is evaporated from the coated inner cores using a stream of air in the fluidised bed sprayer.

The number average weight of each coated inner core (after drying) is 32.2 milligrams and the number average diameter of each bead is 4.1 mm. The average water content of each bead is between about 2 percent and about 3 percent by weight.

A force/displacement test was carried out on the smoking article including the flavour bead using a Texture Analyser and Acoustic Envelope Detector from Stable Micro Systems as detailed above. The smoking article was compressed, at the position of the flavour bead, with a compression rate of 10 mm per minute up to a compression of 5 mm. The force required was plotted as a function of the compression distance in a force/displacement curve, as shown in FIG. 2. During the force/displacement test, the acoustic emission from the smoking article was detected and plotted as a function of the compression distance, as shown in FIG. 2.

As can be seen from FIG. 2, the force/displacement curve 30 includes a plurality of force drops 32 of at least 1 Newton. The acoustic signal 40 comprises an initial phase in which the acoustic output is relatively flat and an elevated phase starting at a compression distance of approximately 2.5 mm, in which a plurality of acoustic peaks 42 having an acoustic level above 65 decibels were detected. The elevated phase extends to a compression distance of approximately 4.5 mm and therefore corresponds to a range of compression of approximately 2 mm. Within the elevated phase, the acoustic signal further comprises a region 44 between approximately 2.5 mm and 3.5 mm in which the acoustic level is sustained above 55 decibels.

The acoustic signal and force/displacement curve demonstrate the sustained crunchiness of the outer shell upon compression, as described in detail above.

EXAMPLE 2

The inner core of the flavour bead is formed as described above for Example 1. Once dried, the inner cores are coated with a coating solution formed of an aqueous solution of the following mixture of compounds:

| Component | Function | Amount (weight percent) |
|---|---|---|
| Shellac | Film-forming polymer | 87.5 |
| Methyl hydroxypropyl cellulose | Film-forming polymer | 7.4 |
| Glycerol | Plasticiser | 5.1 |

The solution contains about 20 percent by weight of the compounds above and 80 percent by weight of water.

The coating solution is applied to the inner cores as described above. The amount of the liquid coating solution applied to the fluidised inner cores corresponds to about 27 percent by weight of the total weight of the inner cores.

The number average weight of each coated inner core (after drying) is 32.4 milligrams and the number average diameter of each bead is 4.0 mm. The average water content of each bead is between about 2 percent and about 3 percent by weight.

EXAMPLE 3

The inner core of the flavour bead is formed as described above for Example 1. Once dried, the inner cores are coated with a coating solution formed of an aqueous solution of the following mixture of compounds:

| Component | Function | Amount (weight percent) |
|---|---|---|
| Methyl hydroxypropyl cellulose | Film-forming polymer | 22.2 |
| Corn starch | Film-forming polymer | 66.7 |
| Glycerol | Plasticiser | 11.1 |

The solution contains about 20 percent by weight of the compounds above and 80 percent by weight of water.

The coating solution is applied to the inner cores as described above. The amount of the liquid coating solution applied to the fluidised inner cores corresponds to about 14 percent by weight of the total weight of the inner cores.

The number average weight of each coated inner core (after drying) is 31.4 milligrams and the number average diameter of each bead is 4.0 mm. The average water content of each bead is between about 2 percent and about 3 percent by weight.

The invention claimed is:

1. A smoking article incorporating a liquid release component, the liquid release component comprising a sustained release liquid delivery material comprising:

an inner core of a sustained release liquid delivery material comprising:

a closed matrix structure comprising a cross-linked polymer matrix defining a plurality of domains, and a liquid composition that is trapped within the domains and is releasable from the closed matrix structure upon compression of the material; and a frangible outer shell encapsulating the inner core of liquid delivery material, wherein the closed matrix structure comprises a filler within the polymer matrix, wherein the filler comprises one or more amphiphilic polysaccharides, wherein the force/displacement curve obtained upon compression of the smoking article at the location of the liquid release component in a force/displacement test comprises a plurality of local minima in the force level over a range of compression of at least 1mm, wherein each of the local minima corresponds to a reduction in the force level of at least 1 Newton, wherein the local minima in the force level are obtained as the frangible outer shell is gradually broken down upon compression.

2. A smoking article according to claim 1 wherein the total number of the local minima in the force level detected over a range of compression of about 2 mm or less is at least 4.

3. A smoking article according to claim 1 wherein at least 2 local minima in the force level are detected per mm of compression.

4. A smoking article according to claim 1 wherein at least one local minima per second is detected in the force level, upon compression of the liquid release component within the smoking article at a rate of 10 mm per minute.

5. A smoking article according to claim 1 upon compression of the liquid release component during the force/displacement test a detected decibel level is sustained above 55 decibels over a range of compression of at least 1 mm.

6. A smoking article according to claim 5 wherein two or more of the local minima in the force level occur whilst the acoustic signal is sustained above 55 decibels.

7. A smoking article according to claim 5 wherein the acoustic signal detected upon compression of the liquid release component during the force/displacement test comprises an elevated phase in which a plurality of acoustic peaks having an elevated decibel level of at least 65 decibels are detected, wherein the elevated phase extends over a range of compression of at least 1 mm.

8. A smoking article according to claim 7 wherein at least one of the acoustic peaks coincides with one of the plurality of local minima in the force level.

9. A smoking article according to claim 7 wherein at least 50 percent of the acoustic peaks have an elevated decibel level of at least 75 decibels.

10. A smoking article according to claim 1 wherein the range of compression over which the local minima in the force level are detected corresponds to at least 20 percent of the dimension of the liquid release component in the direction of the applied force.

11. A smoking article according to claim 1 wherein the first local minimum in the force level is detected at a compression corresponding to at least 30 percent of the dimension of the liquid release component in the direction of the applied force.

12. A smoking article according to claim 1 wherein the dimension of the liquid release component in the direction in which the force is applied in the force/displacement test corresponds to at least 30 percent of the dimension of the smoking article in that direction at the position of the liquid release component.

13. A smoking article according to claim 1 wherein the liquid release component comprises a frangible outer shell comprises at least one film-forming polymer and at least one plasticiser.

14. A smoking article according to claim 13 wherein the frangible outer shell has an average thickness of between 50 microns and 250 microns.

15. A smoking article according to claim 1, wherein the one or more amphiphilic polysaccharides of the filter are chemically modified to be amphiphilic.

16. A smoking article according to claim 2, wherein the one or more amphiphilic polysaccharides of the filter are chemically modified to be amphiphilic.

17. A smoking article according to claim 3, wherein the one or more amphiphilic polysaccharides of the filter are chemically modified to be amphiphilic.

18. A smoking article according to claim 4, wherein the one or more amphiphilic polysaccharides of the filter are chemically modified to be amphiphilic.

19. A smoking article according to claim 5, wherein the one or more amphiphilic polysaccharides of the filter are chemically modified to be amphiphilic.

20. A smoking article according to claim 6, wherein the one or more amphiphilic polysaccharides of the filter are chemically modified to be amphiphilic.

21. A smoking article according to claim 7, wherein the one or more amphiphilic polysaccharides of the filter are chemically modified to be amphiphilic.

22. A smoking article according to claim 8, wherein the one or more amphiphilic polysaccharides of the filter are chemically modified to be amphiphilic.

23. A smoking article according to claim 9, wherein the one or more amphiphilic polysaccharides of the filter are chemically modified to be amphiphilic.

24. A smoking article according to claim 10, wherein the one or more amphiphilic polysaccharides of the filter are chemically modified to be amphiphilic.

25. A smoking article according to claim 11, wherein the one or more amphiphilic polysaccharides of the filter are chemically modified to be amphiphilic.

26. A smoking article according to claim 12, wherein the one or more amphiphilic polysaccharides of the filter are chemically modified to be amphiphilic.

27. A smoking article according to claim 13, wherein the one or more amphiphilic polysaccharides of the filter are chemically modified to be amphiphilic.

28. A smoking article according to claim 14, wherein the one or more amphiphilic polysaccharides of the filter are chemically modified to be amphiphilic.

* * * * *